United States Patent [19]

Adamson

[11] 4,317,261

[45] Mar. 2, 1982

[54] CLEARER FOR DRAWING ROLLS OF SPINNING MACHINES AND THE LIKE

[75] Inventor: Fletcher D. Adamson, Alexander City, Ala.

[73] Assignee: Russell Corporation, Alexander City, Ala.

[21] Appl. No.: 157,326

[22] Filed: Jun. 9, 1980

[51] Int. Cl.[3] ..... D01H 5/60

[52] U.S. Cl. ..... 19/265

[58] Field of Search ..... 19/262, 265; 15/256.51, 15/256.52, 256.53

[56] References Cited

U.S. PATENT DOCUMENTS

| | | | |
|---|---|---|---|
| 2,934,797 | 5/1960 | Whitehurst et al. | 19/262 X |
| 2,951,268 | 9/1960 | West | 19/262 X |
| 3,086,255 | 4/1963 | Cordis | 19/265 |
| 3,902,225 | 9/1975 | Murao | 19/265 |

FOREIGN PATENT DOCUMENTS

| | | | |
|---|---|---|---|
| 1510216 | 8/1969 | Fed. Rep. of Germany | 19/265 |

*Primary Examiner*—Louis Rimrodt

*Attorney, Agent, or Firm*—Woodford R. Thompson, Jr.

[57] ABSTRACT

An improved clearer for the drawing rolls, namely the top rolls, of spinning machines and like equipment. The clearer comprises a main frame or supporting structure for a clearing belt. The frame is pivoted adjacent the rear end of the apparatus. Carried by a portion of the frame are spring members which respectively press the belt into frictional driving engagement with a serrated roller forming part of the roll system and into clearing contact with one of the forward rollers which is to be cleared. The relationship of the parts is such that the belt also engages the upper surface of at least one other roller which is forwardly mounted relative to the roller just mentioned, to clear the same. Also, the clearer is provided with idler rolls for the belt which are located lower than the top of the cross member of the frame thus to reduce the overall vertical dimensions of the device and to get more "wrap" on the forward top roll, resulting in better clearing.

3 Claims, 1 Drawing Figure

FIG. 1
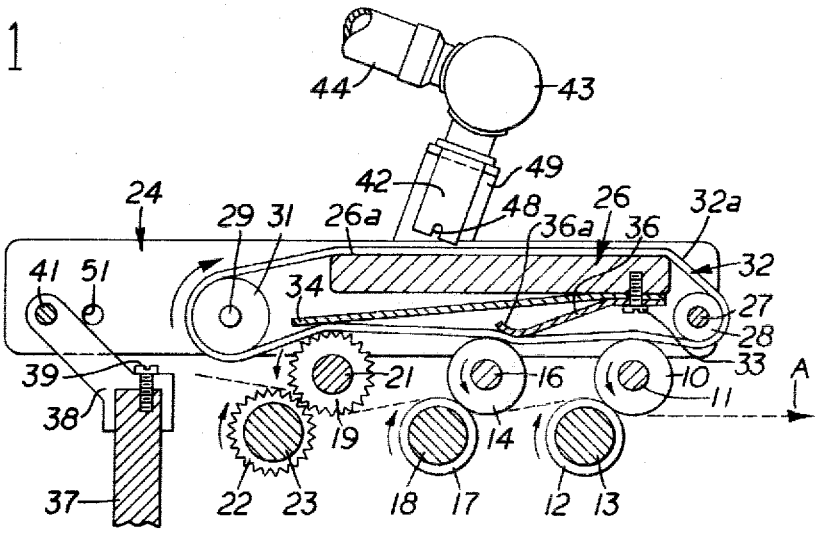
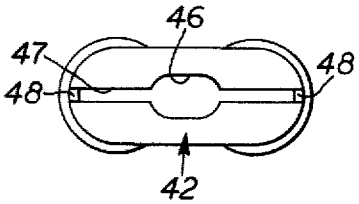
FIG. 3
FIG. 2
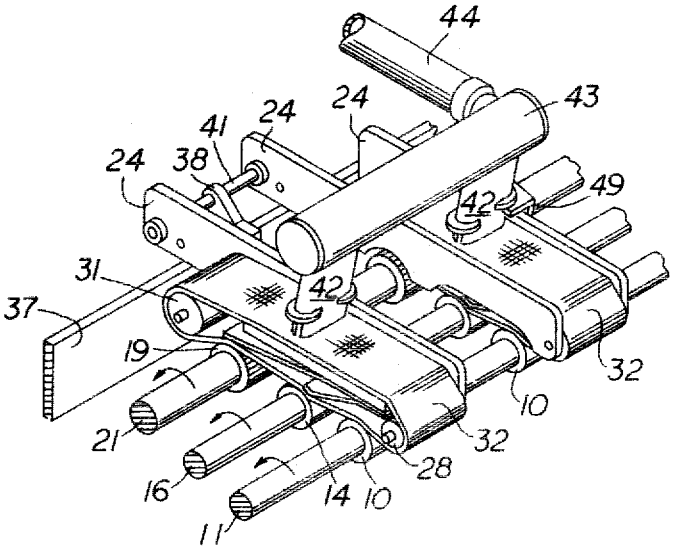

CLEARER FOR DRAWING ROLLS OF SPINNING MACHINES AND THE LIKE

My invention relates to an improved clearer for the drawing rolls of spinning machines and like equipment found in textile mills.

Heretofore it has been proposed to provide belt-type clearers for the top rolls of spinning apparatus. However, to my knowledge the supporting structure for such belt has been permitted to "float" relative to the rolls in the sense that the entire frame, both at its forward and rear ends, could move up and down. By way of example, see U.S. Pat. No. 3,086,255. In normal operation of such floating devices the clearing effect on at least some of the rolls to be cleared is lessened because as the frame moves up and down in response to build-up of material on one of the rolls to be cleaned, the belt tends to move away from one or some of the other rolls to be cleaned. This is especially true in those instances where idler rolls, fixedly mounted in the supporting framework of the belt, are used as clamping rollers to hold the belt in cleaning contact with the rolls to be cleaned. In other prior art attempts to solve this problem the frame has been pivoted adjacent one end to the frame parts of the spinning apparatus, but again, the rolls which press the upper surface of the belt onto the rolls to be cleaned have been fixedly mounted in the frame of the clearer, resulting in the lessening of cleaning action on some rolls when the frame pivots due to build-up and the like on one or some of the rolls. For example, see U.S. Pat. No. 2,951,268.

In view of the foregoing it is an object of my invention to provide an improved clearer of the character designated in which the supporting frame for all of the moving parts of the clearer is pivotally mounted, preferably adjacent the "rear" end of the system and in which individual, separately actuable spring members are employed to force the belt against both the driving roller for the belt and at least one other of the rolls to be cleared.

Still further, an object is to provide apparatus of the character designated in which the belt is trained over idler rolls, these being mounted between side members forming a part of the clearer framework with the upper surfaces of the rolls located below a horizontally disposed cross member between the side members of the clearer framework, whereby I obtain more "wrap" on the forwardmost roll to be cleared and at the same time reduce the overall vertical dimensions of the clearer.

A further object of my invention is to provide apparatus embodying the features just mentioned in which the weight of the apparatus in combination with the spring means mentioned above holds the device in clearing position, eliminating the need for springs and the like to hold it down, thereby permitting ready cleaning of the belt by pivoting the entire apparatus upwardly.

Apparatus illustrating the features of my invention is shown in the accompanying drawings forming a part of this application, in which:

FIG. 1 is a somewhat diagrammatic cross sectional view of a set of drafting rolls of a spinning frame having my improved clearer in place thereon;

FIG. 2 is an isometric view, one of the side plates of the clearer framework being omitted for clarity; and, FIG. 3 is an end view of one of the suction pick-up devices associated with the upper surface of the belt.

Referring now to the drawings for a better understanding of my invention I will show the same in association with a spinning frame having three sets of rollers. Thus, the front (namely, that pair of rolls from which the drawn thread exits the apparatus as shown by the arrow A) comprises an upper rubber-covered roll 10 mounted on a steel spindle 11. As is known in the art the spindles 11 and the rest of such spindles to be described are supported in bearings in the spinning frame so that they may rotate. Cooperating in drafting fashion with roll 10 is a lower roll 12 mounted on a driven spindle 13. Spaced rearwardly from the rolls just described is another upper roll 14 mounted on a spindle 16 with which cooperates a second covered roll 17 mounted on a spindle 18.

Rearwardly of the roll 14 is an upper serrated roll 19 mounted on a spindle 21. The serrated working surface of roll 19 preferably is formed of material such as nylon. The roll 19 is in driving mesh or engagement with the serrated surface of a steel roller 22 mounted on a shaft or spindle 23.

As is known in the art it is customary to drive the respective spindles 13, 18 and 23, usually from the ends of the spindles by a common drive for a multiplicity of the rollers. Suffice it here to say that the spindles 13, 18 and 23 are driven, as is customary, in the directions indicated by the several arrows associated therewith, thus to take sliver in at the rear, between the rollers 19 and 22, and deliver it in attenuated, drawn condition from between the front rollers 10 and 12. Also, while I have shown only three sets of rollers in the system, it will be apparent that my invention will be applicable to a greater number of rollers if desired.

Furthermore, my invention lends itself admirably to mounting on a common pivot point two of the clearer belts for two sets of the rolls already described and it is the construction of one clearer which I will now describe in detail.

First, my improved clearer comprises, for each set of the rolls already described, vertically disposed, spaced side plates 24. The plates 24 are cross-connected by a horizontally disposed belt supporting plate 26 which is secured in suitable fashion at its ends to the side plates 24.

Mounted in the side plates adjacent the forward end of the framework just described is a bearing shaft 27 for an idler roll 28. Similarly, at the opposite or rear end of the frame a bearing shaft 29 supports an idler roll 31. It will be noted that the upper surfaces of the rolls 28 and 31 are below the level of the upper surface 26$^a$ of the plate 26.

Passing somewhat loosely around the rollers 28 and 21 is a clearer belt 32. The belt preferably is made of a closely woven nylon material so that the upper surface 32$^a$ thereof which is the clearing surface of the belt is rough enough to clear the rolls in adequate fashion and yet not so rough as to prevent the suction devices from removing the lint or waste, as will be explained.

Secured by a screw 33 to the under side of the member 26 is a pair of leaf-type spring members 34 and 36. The spring member 34 extends rearwardly far enough to press the belt into driving engagement with the roll 19. The spring member 36 is upturned on its rear end at 36$^a$ and is relatively formed and located so as to press the belt into clearing engagement with the roll 14. It will be noted that the upturned end 36$^a$ gives a good bit more wrap about the roll 14 than would be the case if that end of the member 36 were straight. Furthermore, due to the downward location of the roller 28 and the roller 31 relative to the upper surface 26[a] of plate 26, the belt is caused to have additional wrap about the roller 10 for clearing purposes and about the roller 19 for driving purposes.

As is customary, the spinning apparatus is provided with a longitudinally extending frame member 37. In order to mount my improved apparatus I provide a bracket 38 which is secured to the frame member by means of a screw 39. The bracket member is provided with a hole to receive a pin 41. The pin 41 passes through adjacent vertical plates 24 of a pair of the clearing devices as shown in FIG. 2, whereby a pair of the clearing belts and their frames are supported in pivotal fashion adjacent the rear end of the clearing frames.

Mounted to cooperate with each belt is a suction nozzle 42. A pair of the suction nozzles preferably is connected to a manifold 43 in turn connected to a source of suction through a flexible conduit 44. As best shown in FIG. 1 the lower or suction ends of the nozzle 42 just rest on the surface of the belt 32 to be cleared.

As shown in FIG. 3 the nozzles generally are elongated as viewed in transverse direction, being substantially the length of the width of the belt 32. Also, each nozzle is provided adjacent its suction end with a centrally located generally oval-shaped opening 46. This communicates with an open slot 47, cut completely across the suction end of the nozzle, which slot also extends up each end of the nozzle 42 as shown at 48, FIG. 1. The nozzles may conveniently be supported from shorter ones of the plates 24 by means of a bracket 49 secured to those plates. It will be noted that the lower ends of the nozzles are at an angle, namely, swept back relative to the direction of movement of the surface of the belt to be cleaned and that they run against the surface of the belt to be cleaned with a light contact.

It will be understood that the rolls 10 and 14 are driven at greater surface speeds than the belt 32, thus causing wiping action which deposits lint on the rollers onto the belt.

From the foregoing it will be seen that my improved clearer is simple of construction and efficient in operation. By the combination of pivoting the entire clearer to the frame as distinguished from permitting it to float up and down throughout its length and the spring members 34 and 36, together with locating the idler rolls 28 and 31 as described, I provide not only good driving contact for the belt, but also enhance the clearing of the rollers 10 and 14. Likewise, since the suction may be applied to the manifold 43 by means of a flexible hose, the entire clearer may be lifted upwardly by pivoting it about the pivot 41, to inspect or manually clean the rolls and to replace the same if necessary. Also, the end slots 48 in the clearer nozzles permit the inspiration of some air through those ends as well as through openings 46 and 47, thus clearing the belt across its entire width. In other words, since the nozzle is substantially the width of the belt, but not long enough to contact the side plates 24, the provision of the slots 48 permits an inflow of air from adjacent the edges of the belt, thus to clear any material which is hanging to those edges, thereby, in combination with the centrally disposed hole 46 and slots 47 providing a clearing suction, in efficient fashion, across the entire width of the belt.

At 51 I show an additional hole in each of the side plates 24 located between pairs of the units. This permits the clearer to be adjusted fore and aft of the rolls, in the event of different spacing of the same, as when resetting the rolls for different drafts other than the setting shown in the drawings.

While I have shown my invention in but one form, it will be obvious to those skilled in the art that it is not so limited, but is susceptible of various changes and modifications without departing from the spirit thereof.

What I claim is:

1. In a clearer for the top rolls of a roll assembly of a textile spinning apparatus, said spinning apparatus having a frame member located adjacent the rear of the roll assembly, and an upper, powered, serrated drawing roll located adjacent the rear of the assembly, (a) a clearer frame having horizontally disposed vertical side members and a horizontally disposed belt supporting plate secured between said side members, (b) means pivotally supporting the clearer frame from said apparatus frame member, (c) front and rear horizontally disposed belt idler rolls mounted between the vertically disposed clearer frame members, the top surfaces of said rolls lying below the level of the belt supporting surface of said belt supporting plate, (d) an endless belt passing over said rolls, (e) spring friction means located between the flights of the belt and having one element disposed to press the outer surface of the lower flight of the belt into frictional driving contact with the upper serrated roll and another element disposed to press the outer surface of said belt into clearing engagement with a drawing roll located forwardly of said serrated roll, and (f) the relative dimensions of the parts of the clearer being such that when in position on the spinning apparatus the outer surface of said belt also contacts in clearing engagement at least one other roll located forwardly of the serrated roll.

2. Apparatus as defined in claim 1 in which said clearer is equipped with a suction nozzle disposed with the intake end adjacent the upper surface of the upper flight of said belt, said intake end having a centrally disposed opening and slots extending therefrom transversely of the clearer belt, and means on the clearer frame to hold the suction nozzle in close running contact with said upper surface of the belt.

3. Apparatus as defined in claim 2 in which there are generally vertically extending slots in the ends of the suction nozzle in communication with the slots extending from said centrally disposed opening.

* * * * *